US009975673B2

(12) United States Patent
Prater et al.

(10) Patent No.: US 9,975,673 B2
(45) Date of Patent: May 22, 2018

(54) SQUEEZE AND TURN CHILD RESISTANT CLOSURE ATTACHMENT

(71) Applicant: S. C. Johnson & Son, Inc., Racine, WI (US)

(72) Inventors: Rodney L. Prater, Oak Creek, WI (US); Joel E. Adair, Racine, WI (US); Dirk K. Nickel, Mukwonago, WI (US); Jason R. Gebhardt, Buffalo Grove, IL (US)

(73) Assignee: S.C. JOHNSON & SON, INC., Racine, WI (US)

( * ) Notice: Subject to any disclaimer, the term of this patent is extended or adjusted under 35 U.S.C. 154(b) by 141 days.

(21) Appl. No.: 14/580,441

(22) Filed: Dec. 23, 2014

(65) Prior Publication Data

US 2016/0176590 A1 Jun. 23, 2016

(51) Int. Cl.

| | |
|---|---|
| ***B65D 43/18*** | (2006.01) |
| ***B65D 50/04*** | (2006.01) |
| ***B65D 85/82*** | (2006.01) |
| ***B65D 85/00*** | (2006.01) |
| ***B65D 41/04*** | (2006.01) |

(52) U.S. Cl.

CPC ..... *B65D 50/041* (2013.01); *B65D 41/0492* (2013.01); *B65D 85/70* (2013.01); *B65D 85/82* (2013.01)

(58) Field of Classification Search

CPC ..... B65D 50/041; B65D 41/0492; B65D 50/048; B65D 50/046; B65D 85/70; B65D 85/82; B65D 43/18

USPC ..... 220/259.3, 259.4, 255, 256.1; 215/217, 215/220, 221, 329, 330

See application file for complete search history.

(56) References Cited

U.S. PATENT DOCUMENTS

| | | | | |
|---|---|---|---|---|
| 3,822,805 | A | 7/1974 | Marchant | |
| 3,892,325 | A | 7/1975 | Maguire | |
| 4,002,258 | A | 1/1977 | Curry | |
| 4,134,513 | A | 1/1979 | Mumford | |
| 4,364,484 | A | 12/1982 | Kinsley | |
| 4,834,251 | A * | 5/1989 | Yu | B65D 41/06 215/222 |

(Continued)

FOREIGN PATENT DOCUMENTS

| | | |
|---|---|---|
| EP | 0932557 B1 | 4/2002 |
| EP | 1335864 B1 | 6/2005 |

(Continued)

OTHER PUBLICATIONS

PCT/US2015/060325 International Search Report and Written Opinion dated Feb. 24, 2016.

*Primary Examiner* — Rafael Ortiz

(57) ABSTRACT

A cap-locking assembly includes an inner cap having a ribbed outer surface and a locking cap. The locking cap includes opposing first and second engagement mechanisms, opposing first and second stabilizing ridges, and a plurality of ramped tabs, all of which are disposed on the interior surface of the locking cap. When the ramped tabs engage a lower edge of the inner cap they retain the inner cap inside the locking cap. Further, the opposing first and second stabilizing ridges coaxially align the inner cap and the locking cap. Finally, the opposing first and second engagement mechanisms engage with the ribbed outer surface of the inner cap upon application of an inward force to the locking cap.

20 Claims, 6 Drawing Sheets

(56) References Cited

U.S. PATENT DOCUMENTS

| | | | | |
|---|---|---|---|---|
| 5,165,559 | A | 11/1992 | Kusz | |
| 5,370,251 | A | 12/1994 | Buono | |
| 5,579,934 | A * | 12/1996 | Buono | B65D 50/041 215/219 |
| 5,647,053 | A | 7/1997 | Armin et al. | |
| 5,829,609 | A | 11/1998 | Beck | |
| 5,909,845 | A | 6/1999 | Greatbatch | |
| 5,984,122 | A | 11/1999 | Barker et al. | |
| 6,446,880 | B1 | 9/2002 | Schram et al. | |
| RE38,150 | E | 6/2003 | Greatbatch et al. | |
| 7,815,061 | B1 | 10/2010 | Robinson et al. | |
| 7,988,003 | B1 | 8/2011 | Clodfelter | |
| 8,209,944 | B1 | 7/2012 | Miceli et al. | |
| 8,210,376 | B2 | 7/2012 | Robinson | |
| 8,316,622 | B2 | 11/2012 | Jajoo et al. | |
| 8,479,935 | B2 | 7/2013 | Straughan | |
| 8,590,719 | B2 | 11/2013 | Sprishen et al. | |
| 2007/0045320 | A1 * | 3/2007 | Biesecker | B65D 50/041 220/345.1 |
| 2010/0126997 | A1 * | 5/2010 | Stull, Sr. | B65D 50/041 220/281 |
| 2011/0094990 | A1 * | 4/2011 | Sprishen | B65D 50/041 215/217 |
| 2014/0158790 | A1 * | 6/2014 | Gordon | A01M 1/2044 239/44 |
| 2015/0014269 | A1 * | 1/2015 | Gillman | B65D 50/041 215/206 |

FOREIGN PATENT DOCUMENTS

| | | | |
|---|---|---|---|
| EP | 1863724 | A1 | 12/2007 |
| EP | 1501740 | B1 | 1/2008 |
| EP | 1802534 | B1 | 7/2008 |
| EP | 1723046 | B1 | 11/2008 |
| EP | 2001760 | B1 | 10/2009 |
| EP | 2192050 | A1 | 6/2010 |
| EP | 2148822 | B1 | 4/2011 |
| EP | 2451719 | A1 | 5/2012 |
| EP | 2327633 | B1 | 6/2012 |
| EP | 1799578 | B1 | 10/2012 |
| EP | 2571476 | A2 | 3/2013 |
| EP | 2428461 | B1 | 4/2013 |
| EP | 2634109 | A2 | 9/2013 |
| EP | 2639181 | A2 | 9/2013 |
| EP | 2386497 | B9 | 10/2013 |
| WO | 98/12123 | A1 | 3/1998 |
| WO | 02/28737 | A1 | 4/2002 |
| WO | 2003/076295 | A1 | 9/2003 |
| WO | 03/093129 | A1 | 11/2003 |
| WO | 2005/087604 | A1 | 9/2005 |
| WO | 2006/044003 | A1 | 4/2006 |
| WO | 2007/110106 | A1 | 10/2007 |
| WO | 2008/145674 | A1 | 12/2008 |
| WO | 2011/005924 | A1 | 1/2011 |
| WO | 2011/070581 | A1 | 6/2011 |
| WO | 2011/090913 | A3 | 11/2011 |
| WO | 2011/146664 | A2 | 11/2011 |
| WO | 2012/057557 | A2 | 5/2012 |
| WO | 2014/012066 | A2 | 1/2014 |

* cited by examiner

SQUEEZE AND TURN CHILD RESISTANT CLOSURE ATTACHMENT

CROSS REFERENCE TO RELATED APPLICATIONS

Not applicable.

REFERENCE REGARDING FEDERALLY SPONSORED RESEARCH OR DEVELOPMENT

Not applicable.

SEQUENCE LISTING

Not applicable.

BACKGROUND OF THE INVENTION

1. Field of the Background

The present disclosure relates to container closures, and more particularly, to a child resistant squeeze and turn closure.

2. Description of the Background

Child resistant closures are known for preventing children from opening containers while still remaining easy for an adult to open. Two known types of child resistant closures are referred to as "push and turn" and "squeeze and turn" type closures. In push and turn closures, the user must push down on the closure prior to rotation of same to remove the closure from a container. In squeeze and turn closures a user must first squeeze a portion of the closure prior to rotating same in order to remove the closure from a container.

Many prior art squeeze and turn closures comprise an inner closure component, which is adapted to engage with a neck of a container via a threaded connection. Further, such closures include a squeezable outer closure component that is provided with a pair of locking lugs. The locking lugs are adapted to engage with the inner closure component when the outer closure component is squeezed radially inwardly. When the locking lugs are not engaged with the inner closure component, the outer closure component is free to rotate over the inner closure component without unscrewing the squeeze and turn closure from the container.

A common drawback to these prior art squeeze and turn closures is that the outer component jostles around the inner closure component. This jostling makes it difficult to align the outer and inner closure components when it comes time for a user to open the container. When the outer closure component is not aligned properly, the locking lugs cannot engage the inner closure component, which prevents the opening of the squeeze and turn closure.

There is a need therefore for a two component child resistant closure that does not suffer from the above-noted drawbacks. The present disclosure provides for such a two component closure that comprises stabilizing mechanisms between an inner and outer closure component, which keeps the outer component aligned to allow for quick and safe access to a container by adults without limiting the child safety features of the closure.

SUMMARY OF THE INVENTION

In one aspect, a cap-locking assembly includes an inner cap having a ribbed outer surface and a locking cap. The locking cap includes opposing first and second engagement mechanisms disposed on an interior surface of the locking cap, opposing first and second stabilizing ridges disposed on the interior surface of the locking cap, and a plurality of ramped tabs disposed on the interior surface of the locking cap. When the ramped tabs engage a lower edge of the inner cap they retain the inner cap inside the locking cap. Further, the opposing first and second stabilizing ridges coaxially align the inner cap and the locking cap. Finally, the opposing first and second engagement mechanisms engage with the ribbed outer surface of the inner cap upon application of an inward force to the locking cap.

In a different aspect, a child resistant closure assembly includes a container having a threaded neck portion and a volatile liquid. An inner cap is threadingly attached to the container, wherein the inner cap includes a ribbed outer surface. A locking cap includes opposing first and second engagement mechanisms disposed on an interior surface of the locking cap, opposing first and second stabilizing ridges disposed on the interior surface of the locking cap, and a plurality of ramped tabs disposed on the interior surface of the locking cap. The ramped tabs engage a lower edge of the inner cap to retain the inner cap inside the locking cap. Further, the opposing first and second stabilizing ridges coaxially align the inner cap and the locking cap. Finally, the opposing first and second engagement mechanisms engage with the ribbed outer surface of the inner cap upon application of an inward force to the locking cap.

In still another aspect, a method of providing a cap-locking assembly includes the steps of providing an inner cap having a ribbed outer surface and providing a locking cap. The locking cap includes opposing first and second engagement mechanisms, opposing first and second stabilizing ridges, and a plurality of ramped tabs, all of which are disposed on an interior surface of the locking cap. The ramped tabs engage a lower edge of the inner cap. Further, the opposing first and second stabilizing ridges enable the inner cap and the locking cap to be coaxially aligned. Still further, the opposing first and second engagement mechanisms engage with the ribbed outer surface of the inner cap upon application of an inward force to tabs disposed on an outer surface of the locking cap. Yet another step includes the provision of instructions to a user, which instruct the user to apply an inward force to the tabs of the locking cap, rotate the cap-locking assembly, and remove the cap-locking assembly from a container.

DETAILED DESCRIPTION OF THE DRAWINGS

Figure 1:
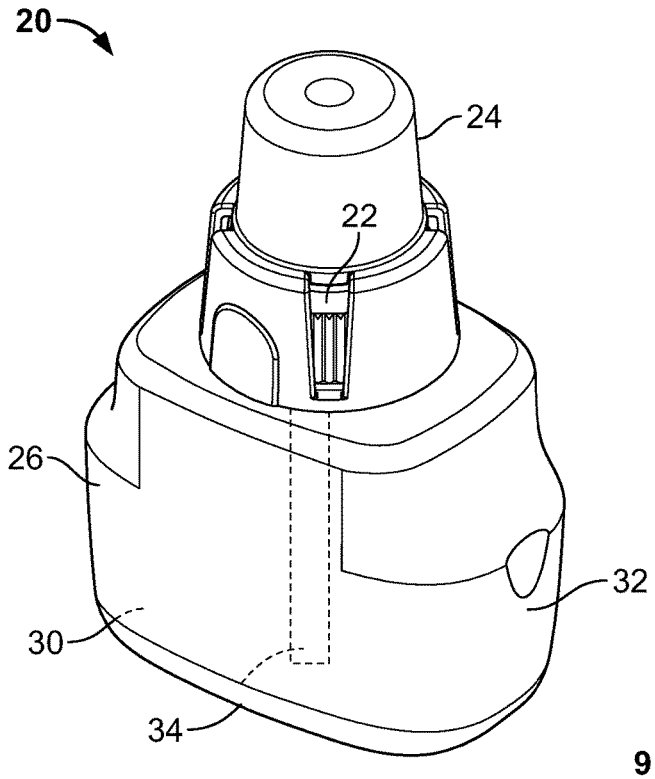
FIG. 1 is an isometric view of a child resistant cap assembly on a container with a wick.

FIGS. 1-10 generally depict a child resistant cap-locking assembly 20. The cap-locking assembly 20 includes an inner cap 22 and an outer locking cap 24. The cap-locking assembly 20 is adapted to be screwed onto a container 26 comprising a threaded neck portion 28 and a volatile liquid 30 provided within a reservoir 32. In the current embodiment, the container 26 also comprises a wick 34 and a wick adapter 36 fittingly attached inside the threaded neck portion 28 (see FIG. 4). The wick 34 extends through the reservoir 32, up through the wick adapter 36, and finally into the inner cap 22. In order for the wick 34 to transfer the volatile liquid 30 out of the container 26 by capillary action, the wick 34 is preferably formed from conventional wicking materials. Suitable wicking materials include porous/sintered plastics such as ultra high density polyethylene and polypropylene; bonded fibers such as polyesters and polypropylene; glass-sintered fibers; porous ceramics; carbon fibers; sintered carbon; compressed wood composites; bundled or woven natural fibers such as cotton, wood, or linen; and bundled or woven man made fibers such as nylon, polypropylene, polyethylene, polyesters, polyamides, rayon, polyacetates, etc. In other embodiments the container 26 does not have a wick 34.

The volatile liquid 30 may be a fragrance, insecticide, a deodorizer, a fungicide, a bacteriocide, a sanitizer, a pet barrier, or other active volatile or other compound disposed within a carrier liquid (for example, an oil-based and/or water-based carrier), a deodorizing liquid, or the like. For example, the fluid may comprise a pest control active, an air and carpet sanitizer, or a deodorant. The fluid may also comprise other actives, such as sanitizers, air and/or fabric fresheners, cleaners, odor eliminators, mold or mildew inhibitors, insect repellents, and the like, or others that have aromatherapeutic properties. The fluid alternatively comprises any fluid known to those skilled in the art that can be dispensed from a container.

Figure 3:
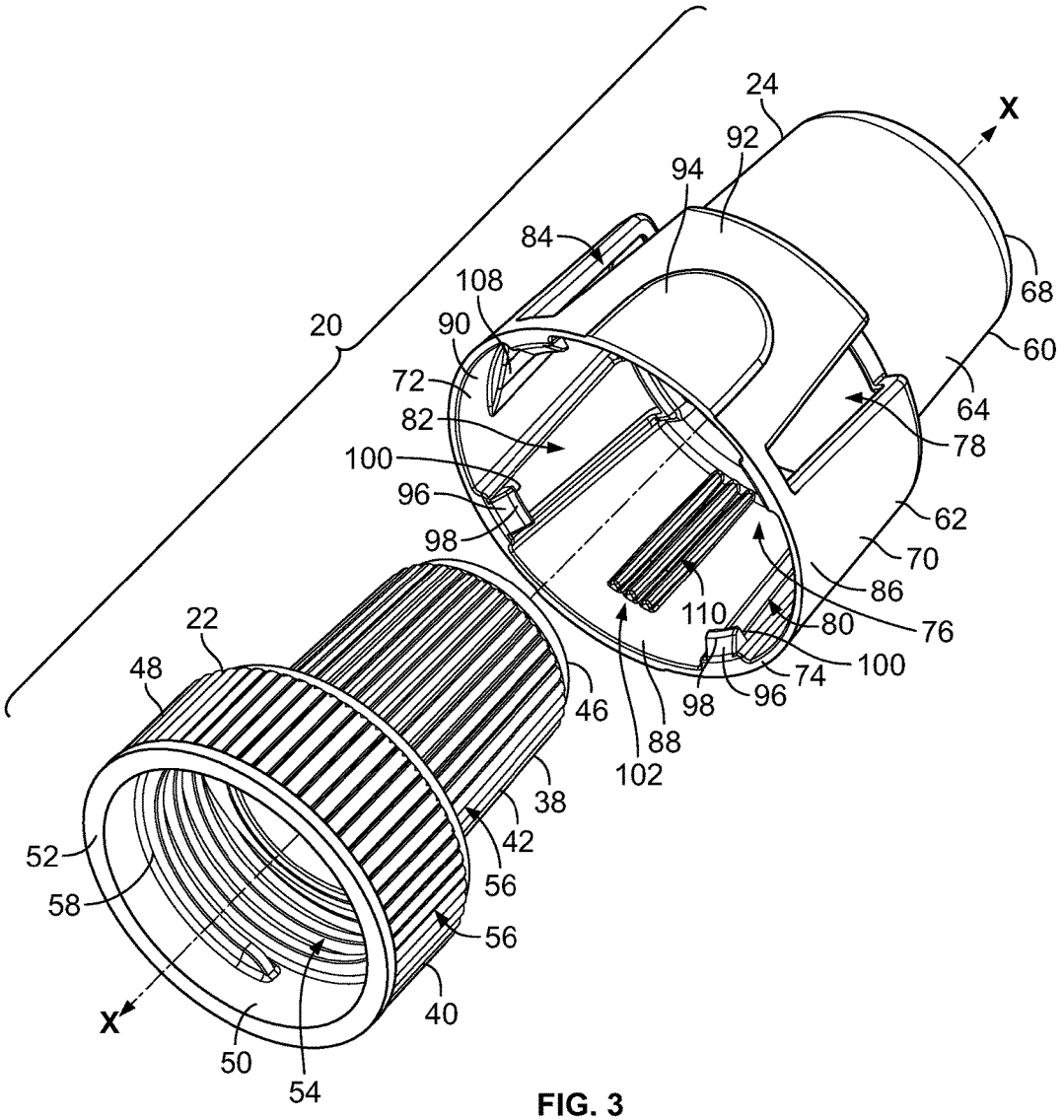
FIG. 3 is an exploded isometric view of the child resistant cap assembly of FIG. 2.

Turning to FIG. 3, the inner cap 22 comprises an upper portion 38 and a lower portion 40. The lower portion 40 of the inner cap 22 has a larger diameter than the upper portion 38 of the inner cap 22. Preferably, the upper and lower portions 38, 40 are generally cylindrical in cross-section and may include varying diameters about a longitudinal axis X of the cap-locking assembly 20. In one embodiment, the upper portion 38 has a greatest diameter of about 15-20 mm and the lower portion 40 has a greatest diameter of about 25-30 mm, in which lower ends of the portions 38, 40 preferably have greater diameters than upper ends thereof. With reference still to FIG. 3, the upper portion 38 has an outer surface 42, an interior surface 44 (see FIG. 4), and an upper wall 46. Similarly, the lower portion 40 of the inner cap 22 has an outer surface 48, an interior surface 50, and a lower edge 52. Further, the inner cap 22 includes an elongate interior recess 54. The elongate interior recess 54 extends along the longitudinal axis X of the cap-locking assembly 20 starting at the lower edge 52 of the lower portion 40 and extends upwardly to the upper wall 46 of the upper portion 38. The elongate interior recess 54 is defined by the interior surfaces 44 and 50 of the upper and lower portions 38 and 40, respectively, and the upper wall 46. In the present embodiment, the elongate interior recess 54 is adapted to receive the wick 34, the wick adapter 36, and the threaded neck portion 28 of the container 26 (see FIG. 4). Vertically extending ribs 56 are provided on the outer surfaces 42 and 48 of the upper portion 38 and the lower portion 40, respectively. Further, the interior surface 50 of the lower portion 40 includes a threaded portion 58 that is adapted to engage with the threaded neck portion 28 of the container 26.

Figure 4:
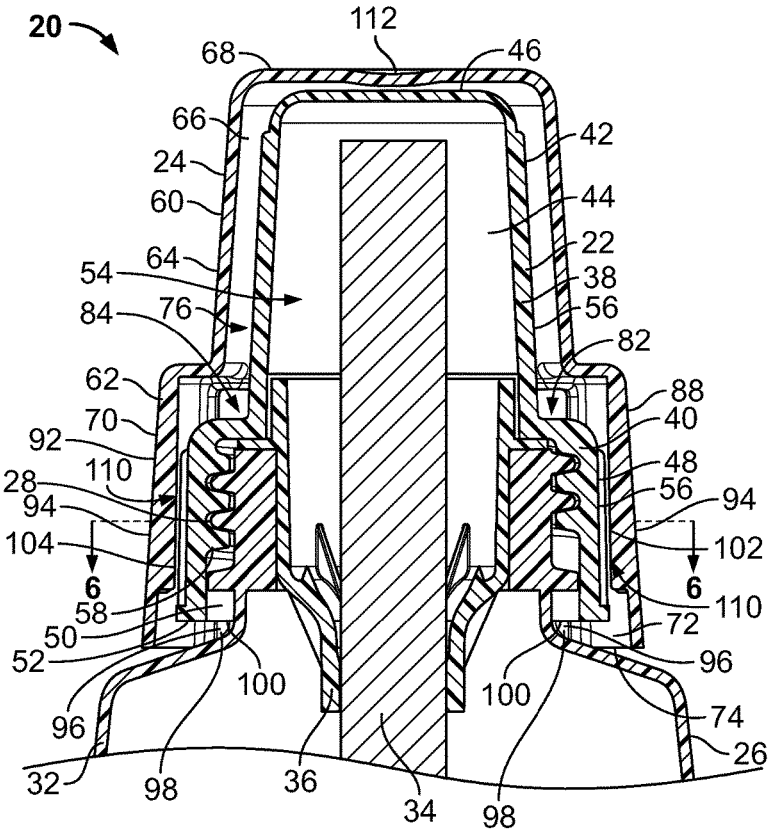
FIG. 4 is a cross-sectional view of the child resistant cap assembly taken generally along the lines 4-4 of FIG. 2, further including a portion of the wick and the container of FIG. 1.

Referring again to FIGS. 2 and 3, the outer locking cap 24 comprises an upper portion 60 and a lower portion 62. The lower portion 62 of the locking cap 24 has a larger diameter than the upper portion 60 of the locking cap 24. Preferably, the upper and lower portions 60, 62 are generally cylindrical in cross-section and may include varying diameters about the longitudinal axis X of the cap-locking assembly 20. In one embodiment, the upper portion 60 has a greatest diameter of about 18-23 mm and the lower portion 62 has a greatest diameter of about 30-35 mm, in which lower ends of the portions 60, 62 preferably have greater diameters than upper ends thereof. With reference now to FIG. 4, the upper portion 60 of the locking cap 24 has an outer surface 64, an interior surface 66, and an upper wall 68. Similarly, the lower portion 62 of the locking cap 24 has an outer surface 70, an interior surface 72, and a lower edge 74. Further, the locking cap 24 includes an elongate interior recess 76. The elongate interior recess 76 extends along the longitudinal axis X of the cap-locking assembly 20 starting at the lower edge 74 of the lower portion 62 and extends upwardly to the upper wall 68 of the upper portion 60. The elongate interior recess 76 is defined by the interior surfaces 66 and 72 of the upper and lower portions 60 and 62, respectively, and the upper wall 68. In the present embodiment, the elongate interior recess 76 is adapted to receive the inner cap 22 (see FIG. 4).

Figure 2:
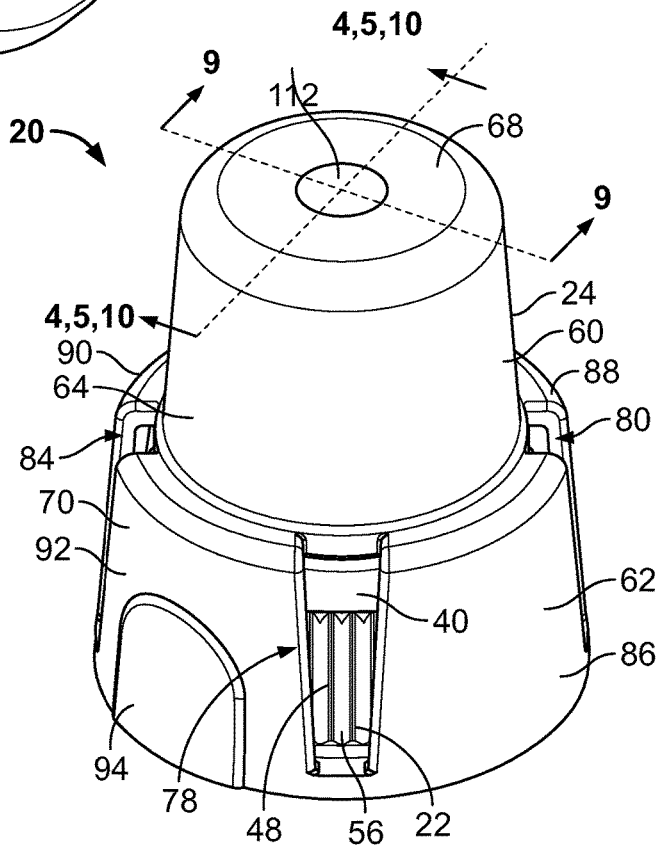
FIG. 2 is an isometric view of the child resistant cap assembly of FIG. 1.
Figure 6:
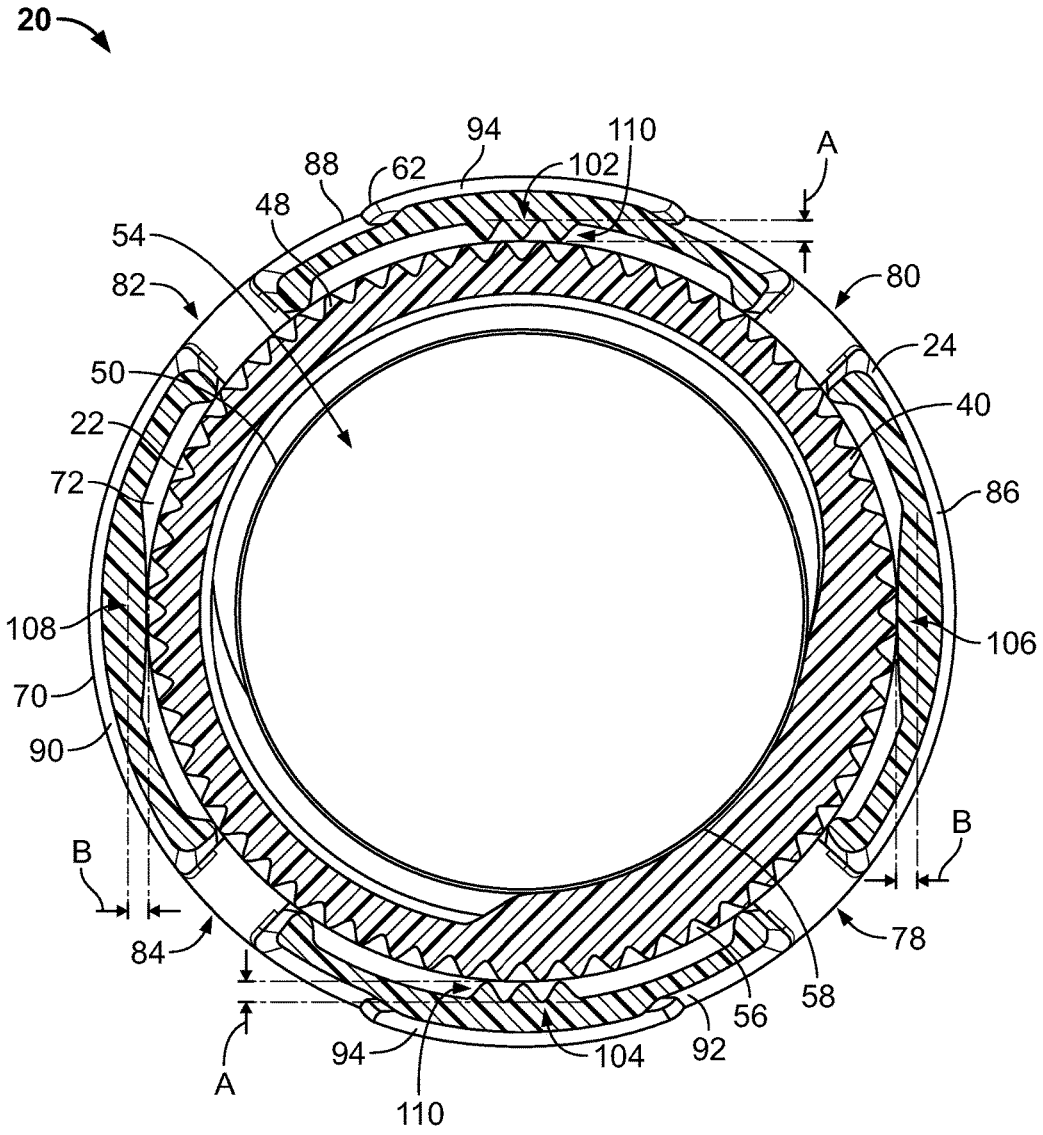
FIG. 6 is a cross-sectional view of the child resistant cap assembly taken generally along the lines 6-6 of FIG. 4 with the wick and the container removed for purposes of clarity.

Now referring to FIGS. 2, 3, and 6, the lower portion 62 of the locking cap 24 includes first, second, third, and fourth apertures 78, 80, 82, 84, respectively. Preferably, the apertures 78-84 are provided equidistantly about the lower portion 62, so that the first and third apertures 78, 82 are located 180 degrees from one another, and the second and fourth apertures 80, 84 are also located 180 degrees from one another (see FIG. 6). Further, in this embodiment, the first aperture 78 is located 90 degrees away from the second aperture 80, the second aperture 80 is located 90 degrees away from the third aperture 82, the third aperture 82 is located 90 degrees away from the fourth aperture 84, and the fourth aperture 84 is located 90 degrees away from the first aperture 78. In alternative embodiments, the first through fourth apertures 78-84 may be located any radial distance away from one another.

Still referring to FIG. 6, the lower portion 62 may be generally characterized as comprising first, second, third, and fourth wall sections 86, 88, 90, 92, respectively, defined by the placement of the apertures 78-84. Therefore, the first wall section 86 is opposite the third wall section 90 (see FIG. 9) and the second wall section 88 is opposite the fourth wall section 92 (see FIG. 10). Opposing outwardly extending finger tabs 94 are provided on the outer surface 70 of the lower portion 62, which in the present embodiment are located on the opposing second and fourth wall sections 88, 92.

Figure 9:
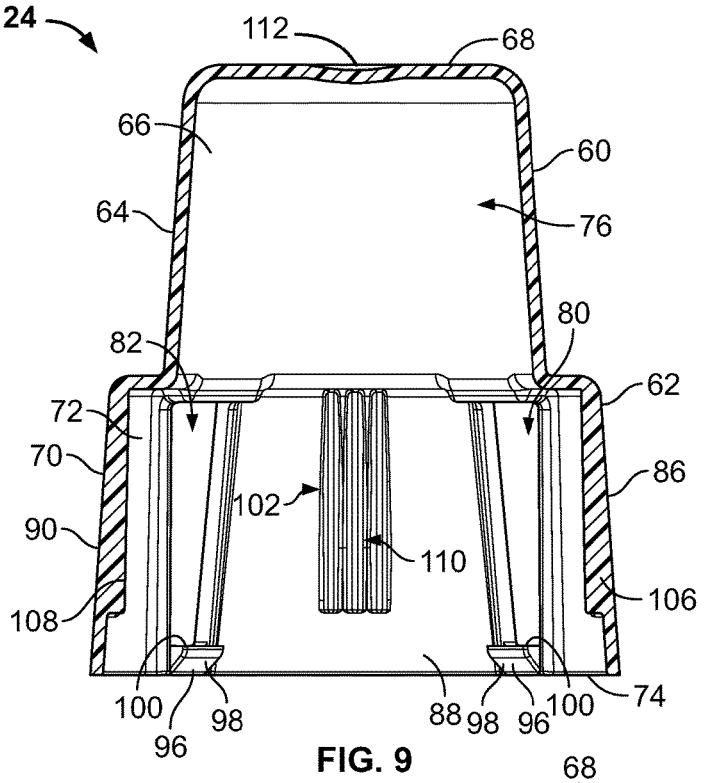
FIG. 9 is a cross-sectional view of a locking cap of the child resistant cap assembly taken generally along the lines 9-9 of FIG. 2.
Figure 10:
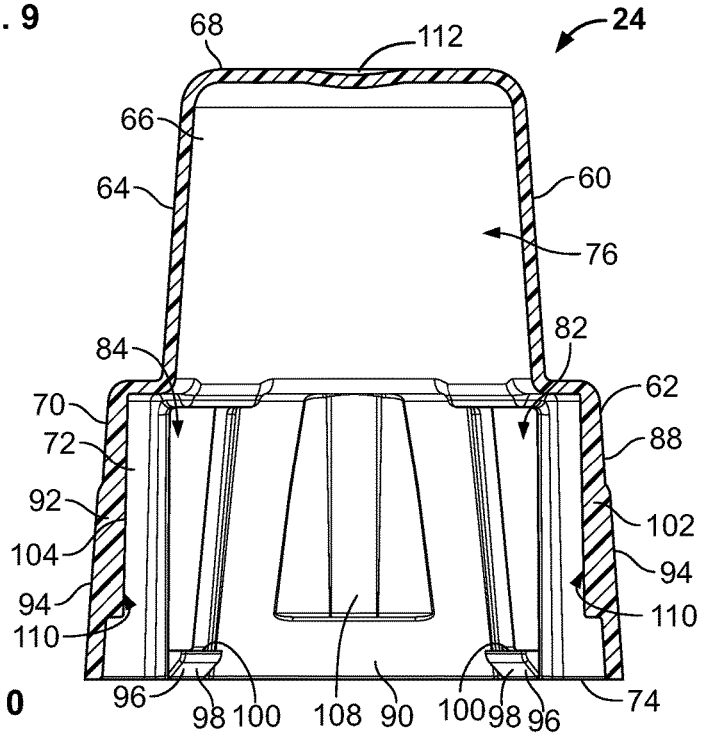
FIG. 10 is a cross-sectional view of a locking cap of the child resistant cap assembly taken generally along the lines 10-10 of FIG. 2.

Referring to FIGS. 3, 9, and 10, the lower boundaries of the first, second, third, and fourth apertures 78-84, are defined by a plurality of ramped tabs 96 disposed on the interior surface 72 of the lower portion 62. The ramped tabs 96 include an angled surface 98 and a flat surface 100, which is parallel to the lower edge 74. The angled surface 98 of the ramped tab 96 extends upwardly and inwardly from the lower edge 74 of the locking cap 24 toward the center of the locking cap 24. In one embodiment, four equidistantly spaced ramped tabs 96 are provided. In another embodiment, the plurality of ramped tabs 96 may comprise fewer or greater numbers of tabs, or, may be located equidistantly or non-equidistantly from one another.

With reference to FIGS. 3 and 9, the interior surface 72 of the lower portion 62 of the locking cap 24 includes first and second engagement mechanisms 102, 104, respectively. In a preferred embodiment, the first and second engagement mechanisms 102, 104 are provided opposite one another. In another embodiment, the first engagement mechanism 102 may be characterized as being disposed on the second wall section 88 and the second engagement mechanism 104 as being disposed on the fourth wall section 92 (see FIG. 6). Now turning to FIGS. 3 and 10, the interior surface 72 of the lower portion 62 is also provided with first and second stabilizing ridges 106, 108, respectively. In a preferred embodiment, the first and second stabilizing ridges 106, 108 are similarly provided opposite one another. With reference again to FIG. 6, in another preferred embodiment the first stabilizing ridge 106 may be characterized as being disposed on the first wall section 86 and the second stabilizing ridge 108 as being disposed on the third wall section 90. In this embodiment, the first engagement mechanism 102, the second engagement mechanism 104, the first stabilizing ridge 106, and the second stabilizing ridge 108 are disposed in the center of each corresponding wall section 88, 92, 86, 90, respectively. In another embodiment, the first and second engagement mechanisms 102, 104 and the first and second stabilizing ridges 106, 108 may be provided at any position on the interior surface 72 of each corresponding wall section so that the engagement mechanisms and stabilizing ridges may be spaced 90 degrees from one another or some other non-equidistant radial placement from one another.

With reference to FIG. 9, the first engagement mechanism 102 comprises three inwardly facing ribs 110. In another embodiment, the first engagement mechanism 102 may comprise fewer or greater than three inwardly facing ribs 110. The ribs include a generally arcuate or curvilinear shape and, in one particular embodiment, have a greatest inward radial dimension A measured from the interior surface 72 of the lower portion 62 of 2-5 mm (see FIG. 6). However, the inward radial dimension of the ribs 110 may be modified, insofar as the ribs do not fittingly engage with the ribs 56 of the outer surface 48 of the lower portion 40 of the inner cap 22 in a rest state. Further, the ribs 110 extend from an upper end of the lower portion 62 downwardly toward the ramped tab 96. However, it is also anticipated that one or more of the ribs 110 comprising the first engagement mechanism 102 may extend above or below the ramped tab 96 as well as the upper end of the lower portion 62. Similarly, in a preferred embodiment the opposing second engagement mechanism 104 is structurally identical to the first engagement mechanism 102, however, differences between the two may be contemplated insofar as the functionality of the engagement mechanisms is not compromised.

Turning to FIG. 10, the second stabilizing ridge 108 is shown. The stabilizing ridge 108 comprises an inwardly extending single curvilinear surface, and in one embodiment, has a greatest inward radial dimension B measured from the interior surface 72 of the lower portion 62 of 2-5 mm (see FIG. 6). However, the inward radial dimension of the stabilizing ridge 108 may be modified in other embodiments. Further, the stabilizing ridge 108 extends from an upper end of the lower portion 62 downwardly toward the ramped tab 96. Preferably, the stabilizing ridge 108 extends in a similar manner and has similar length dimensions as the corresponding engagement mechanisms 102, 104 provided on the lower portion 62. However, it is also anticipated that the stabilizing ridge 108 may extend above or below the ramped tab 96, above or below the upper end of the lower portion 62, or may have different dimensions than the corresponding engagement mechanisms 102, 104. Similarly, in a preferred embodiment the opposing first stabilizing ridge 106 is structurally identical to the second stabilizing ridge 108, however, differences between the two may be contemplated insofar as the functionality of the stabilizing ridges is not compromised.

Figure 5:
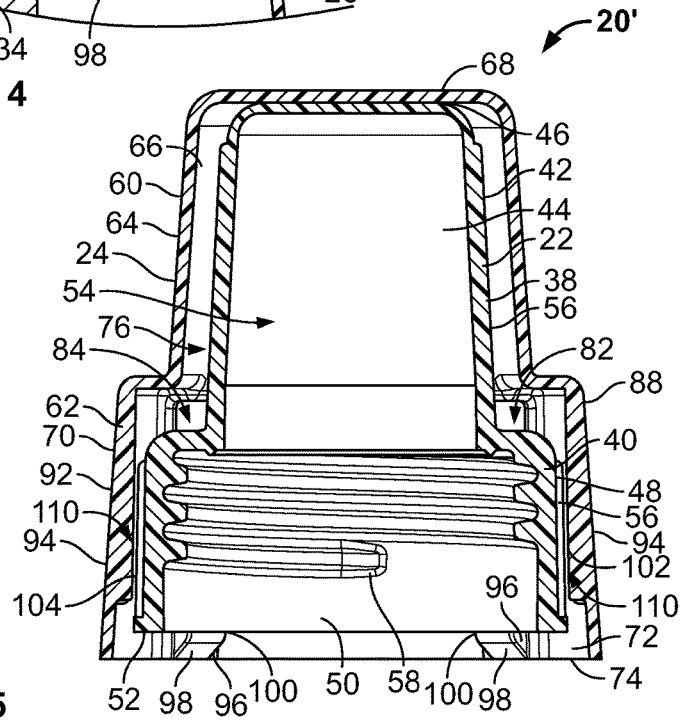
FIG. 5 is an alternative embodiment of the child resistant cap assembly of FIG. 4.

As seen in FIG. 3, the cap-locking assembly 20 is assembled by placing the locking cap 24 over the inner cap 22. The lower portion 62 of the locking cap 24 is slid over the upper portion 38 of the inner cap 22 with little contact between the interior surface 72 of the lower portion 62 of the locking cap 24 and the outer surface 42 of the upper portion 38 of the inner cap 22. As the lower edge 74 of the lower portion 62 of the locking cap 24 reaches the lower portion 40 of the inner cap 22, the angled surfaces 98 of the ramped tabs 96 contact the outer surface 48 of the lower portion 40 of the inner cap 22 until the flat surfaces 100 of the ramped tabs 96 fully ride over the outer surface 48 and engage the lower edge 52 of the inner cap 22. This engagement is effected by resilient deformation of portions of the lower portion 62 of the locking cap 24, wherein securement of the ramped tabs 96 beneath the lower edge 52 of the inner cap 22 provides for a permanent connection. In one embodiment, seen in FIG. 4, once the inner cap 22 is retained within the elongate interior recess 76 of the locking cap 24, the upper wall 46 of the inner cap 22 abuts against a dimple 112 or other surface variation disposed on the upper wall 68 of the locking cap 24 to allow for no, or substantially no, axial movement of the locking cap 24 about the inner cap 22. FIG. 5 shows an alternative embodiment of a cap-locking assembly 20' where the upper wall 68 of the locking cap 24 contains no dimple or surface variation so that the upper wall 46 of the inner cap 22 is in contact with the flat upper wall 68 of the locking cap 24. This embodiment requires the upper portion 60 of the locking cap 24 to be of a shorter height than the upper portion 60 of the embodiment with the dimple 112 in order to allow for no, or substantially no, axial movement of the locking cap 24 about the inner cap 22.

Once the inner cap 22 is retained inside of the elongate interior recess 76 of the locking cap 24, the first and second stabilizing ridges 106, 108 abut against vertically extending ribs 56 provided on the outer surface 48 of the lower portion 40 of the inner cap 22 (see FIG. 6). This non-engaging contact enables the locking cap 24 and the inner cap 22 to be coaxially aligned with a longitudinal axis X. In a rest state, the ribs 110 of the first and second engagement mechanisms 102, 104 do not fittingly engage with the ribs 56 of the outer surface 48 of the lower portion 40 of the inner cap 22. In this rest state, the only movement allowed is a rotational movement of the locking cap 24 around the longitudinal axis X of the cap-locking assembly 20. No, or substantially no, axial movement will result from a user pulling on the locking cap 24 because of the engagement of the flat surfaces 100 of the ramped tabs 96 with the lower edge 52 of the inner cap 22 and the engagement of the dimple 112 provided on the upper wall 68 of the locking cap 24 with the upper wall 46 of the inner cap 22.

Figure 7:
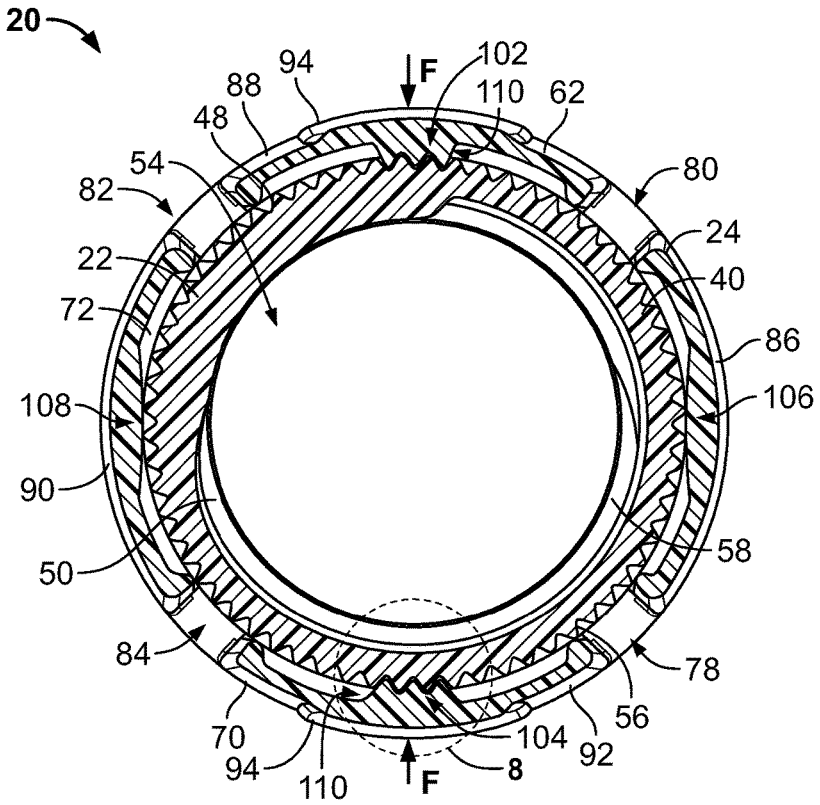
FIG. 7 is a view of the child resistant cap assembly of FIG. 6 in an operative state.
Figure 8:
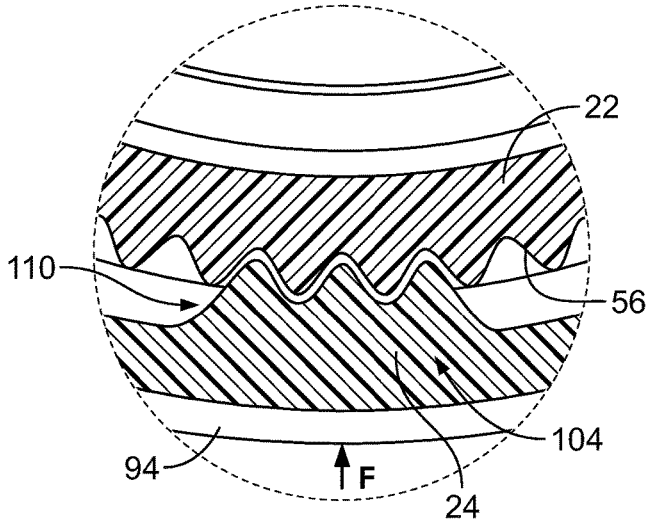
FIG. 8 is a partial, enlarged view of an engagement mechanism depicted in FIG. 7.

Referring to FIGS. 6-8, the cap-locking assembly 20 is removed from the container 26 through a squeeze and turn mechanism. FIG. 6 shows the cap-locking assembly 20 in a rest state. In this rest state, a user can rotate the locking cap 24 about the longitudinal axis X without removing the cap-locking assembly 20 from the container 26. FIG. 7 shows the cap-locking assembly 20 in an engaged, squeezed state. In this engaged state, a user applies a radially inward force F to the tabs 94 on the lower portion 62 of the locking cap 24, which in the present embodiment are located on the opposing second and fourth wall sections 88, 92. This radially directed inward force causes the ribs 110 of the first engagement mechanism 102 and the second engagement mechanism 104 to interlock with the ribs 56 of the outer surface 48 of the lower portion 40 of the inner cap 22. The interlocking of the engagement ribs 110 and the ribs 56 can be seen in more detail in FIG. 8. Once the engagement ribs 110 and the ribs 56 are engaged with one another, a user rotates the entire cap-locking assembly 20 about the longitudinal axis X and lifts upwardly to unthread and remove the cap-locking assembly 20 from the container 26. The cap-locking assembly 20 can only be removed from the container 26 when the ribs 110 of the first engagement mechanism 102 and the ribs 110 of the second engagement mechanism 104 are both interlocked with the ribs 56 of the inner cap 22. This squeeze and turn mechanism makes it difficult for children to open because it requires a user to squeeze the designated portions, engage the locking cap 24 and the inner cap 22 together, and to twist and lift the locking cap 24 and the inner cap 22 upwardly to unthread the cap-locking assembly 20.

In some cases the locking cap 24 may already be provided on the inner cap 22 so the step of sliding the locking cap 24 over the inner cap 22 is not needed. In other cases, when an existing cap includes vertically outwardly extending ribs on an outer surface, the locking cap 24 may be added to make the closure child-resistant if so desired.

When the locking cap 24 is added to an existing cap closure, instructions may be provided indicating a procedure for utilizing the assembly. Such instructions may include the steps of sliding the locking cap 24 over the existing cap, applying an inward force F to the tabs 94 of the locking cap 24, rotating the cap-locking assembly 20, and removing the cap-locking assembly 20 from a container 26. If the locking cap 24 is already secured onto the inner cap 22, the first step of the instructions may be omitted.

The exemplary embodiments disclosed herein are not intended to be exhaustive or to unnecessarily limit the scope of the invention. The exemplary embodiments were chosen and described in order to explain the principles of the present invention so that others skilled in the art may practice the invention. As will be apparent to one skilled in the art, various modifications can be made within the scope of the aforesaid description. Such modifications being within the ability of one skilled in the art form a part of the present invention and are embraced by the appended claims.

Other embodiments of the disclosure including all the possible different and various combinations of the individual features of each of the foregoing described embodiments and examples are specifically included herein.

INDUSTRIAL APPLICABILITY

Numerous modifications to the present invention will be apparent to those skilled in the art in view of the foregoing description. Accordingly, this description is to be construed as illustrative only and is presented for the purpose of enabling those skilled in the art to make and use the invention and to teach the best mode of carrying out same. The exclusive rights to all modifications which come within the scope of the appended claims are reserved.

We claim:

1. A cap-locking assembly, comprising:

an inner cap having a lower portion, wherein the lower portion includes a ribbed outer surface; and a locking cap including opposing first and second engagement mechanisms disposed on an interior surface of the locking cap, opposing first and second stabilizing ridges disposed on the interior surface of the locking cap, and a plurality of ramped tabs disposed on the interior surface of the locking cap, wherein the ramped tabs engage a lower edge of the inner cap to retain the inner cap inside the locking cap, wherein the opposing first and second stabilizing ridges coaxially align the inner cap and the locking cap, and wherein the opposing first and second engagement mechanisms fittingly engage with the ribbed outer surface of the lower portion of the inner cap only upon application of an inward force to the locking cap.

2. The cap-locking assembly of claim 1, wherein one of the first and the second engagement mechanisms includes inwardly facing ribs.

3. The cap-locking assembly of claim 1, wherein the first and the second engagement mechanisms are disposed 180° apart from one another.

4. The cap-locking assembly of claim 3, wherein the first and second stabilizing ridges are disposed 180° apart from one another.

5. The cap-locking assembly of claim 4, wherein one of the first or the second engagement mechanisms is located 90° apart from one of the first or the second stabilizing ridges.

6. The cap-locking assembly of claim 1, wherein the locking cap comprises equidistantly spaced ramped tabs.

7. The cap-locking assembly of claim 1, wherein the inner cap and the locking cap are generally of the same shape and each of the inner cap and the locking cap includes an elongate interior recess along a longitudinal axis.

8. The cap-locking assembly of claim 1, wherein the locking cap includes a lower portion having a first wall section, a second wall section, a third wall section, and a fourth wall section.

9. The cap-locking assembly of claim 8, wherein two finger tabs are provided on two of the wall sections of the lower portion of the locking cap.

10. The cap-locking assembly of claim 1, wherein the locking cap includes a dimple on an upper wall that allows for substantially no axial movement of the locking cap about the inner cap.

11. The child resistant closure assembly of claim 1, wherein the ribbed outer surface has a length that extends along a substantial portion of the lower portion.

12. The child resistant closure assembly of claim 11, wherein the inner cap includes an upper portion with a ribbed outer surface.

13. A child resistant closure assembly, comprising:

a container having a threaded neck portion;

an inner cap threadingly attached to the container, wherein the inner cap has an upper portion and a lower portion, wherein the lower portion includes a ribbed outer surface; and a locking cap having an upper portion with a first diameter and a lower portion with a second diameter, wherein the locking cap includes opposing first and second engagement mechanisms disposed on an interior surface of the locking cap, opposing first and second stabilizing ridges disposed on the interior surface of the locking cap and extending from an upper end of the lower portion of the locking cap, and a plurality of ramped tabs disposed on the interior surface of the locking cap, wherein the ramped tabs engage a lower edge of the inner cap to retain the inner cap inside the locking cap, wherein the opposing first and second stabilizing ridges coaxially align the inner cap and the locking cap, and wherein the opposing first and second engagement mechanisms engage with the ribbed outer surface of the lower portion of the inner cap only upon application of an inward force to the locking cap.

14. The child resistant closure assembly of claim 13, wherein the container contains a liquid selected from the group consisting of a fragrance, a disinfectant, a sanitizing agent, an insect repellent, an insecticide, and combinations thereof.

15. The child resistant closure assembly of claim 13, wherein at least one of the first and second engagement mechanisms includes inwardly facing ribs.

16. The child resistant closure assembly of claim 13, wherein the first and second engagement mechanisms are disposed 180° apart from one another.

17. The child resistant closure assembly of claim 16, wherein the first and second stabilizing ridges are disposed 180° apart from one another.

18. The child resistant closure assembly of claim 13, wherein the inner cap further comprises an elongate interior recess along a longitudinal axis, and wherein the container further includes a wick extending upwardly through the threaded neck portion of the container into the interior recess of the inner cap.

19. The child resistant closure assembly of claim 13, wherein the ribbed outer surface has a length that extends along a substantial portion of the lower portion of the inner cap.

20. The child resistant closure assembly of claim 19, wherein the upper portion of the inner cap includes a ribbed outer surface.

* * * * *